US009514702B2

(12) United States Patent
Jung

(10) Patent No.: US 9,514,702 B2
(45) Date of Patent: Dec. 6, 2016

(54) SOURCE DRIVER CIRCUIT, METHOD FOR DRIVING DISPLAY PANEL AND DISPLAY DEVICE

(71) Applicant: BOE TECHNOLOGY GROUP CO., LTD., Beijing (CN)

(72) Inventor: Chulgyu Jung, Beijing (CN)

(73) Assignee: BOE TECHNOLOGY GROUP CO., LTD. (CN)

( * ) Notice: Subject to any disclaimer, the term of this patent is extended or adjusted under 35 U.S.C. 154(b) by 100 days.

(21) Appl. No.: 14/558,280

(22) Filed: Dec. 2, 2014

(65) Prior Publication Data

US 2016/0063959 A1 Mar. 3, 2016

(30) Foreign Application Priority Data

Aug. 28, 2014 (CN) ..... 2014 1 0433197

(51) Int. Cl.
*G09G 3/36* (2006.01)

(52) U.S. Cl.
CPC ..... *G09G 3/3696* (2013.01); *G09G 3/3614* (2013.01); *G09G 3/3685* (2013.01); *G09G 2300/0426* (2013.01); *G09G 2300/0452* (2013.01); *G09G 2310/0289* (2013.01); *G09G 2320/0209* (2013.01)

(58) Field of Classification Search
CPC ..... G09G 2300/0426; G09G 2300/0452; G09G 2310/0289; G09G 2320/0209
See application file for complete search history.

(56) References Cited

U.S. PATENT DOCUMENTS

2005/0206629 A1* 9/2005 Tseng ..... G09G 3/3688 345/204
2006/0152466 A1* 7/2006 Kim ..... G09G 3/3688 345/100
2007/0097056 A1* 5/2007 Tseng ..... G09G 3/3614 345/96

(Continued)

FOREIGN PATENT DOCUMENTS

CN 1350279 A 5/2002
CN 101317212 A 12/2008
CN 101452682 A 6/2009

(Continued)

OTHER PUBLICATIONS

Office Action in Chinese Patent Application No. 201410433197.8, dated Feb. 1, 2016.

(Continued)

*Primary Examiner* — Andrew Sasinowski
*Assistant Examiner* — Chun-Nan Lin
(74) *Attorney, Agent, or Firm* — Bakerhostetler LLP

(57) ABSTRACT

The present disclosure provides a source driver IC. A first sub-driver circuit is provided to, within a time period, control polarities of driving voltages for a first subpixel and a third subpixel in pixel units at odd-numbered positions in a pixel row to be reverse to polarities of driving voltages for a second subpixel and a fourth subpixel in the pixel units at the odd-numbered positions in the pixel row, and a second sub-driver circuit is provided to, within the time period, control polarities of driving voltages for a first subpixel and a third subpixel in the pixel units at even-numbered positions to be identical to polarities of driving voltages for the second subpixel and the fourth subpixel in the pixel units at the odd-numbered positions but reverse to polarities of driving voltages for the second subpixel and the fourth subpixel in the pixel units at the even-numbered positions.

14 Claims, 3 Drawing Sheets

(56) References Cited

U.S. PATENT DOCUMENTS

2008/0074369 A1* 3/2008 Hsu ..... G09G 3/3614 345/88
2009/0040243 A1* 2/2009 Hisada ..... G09G 3/3614 345/690

FOREIGN PATENT DOCUMENTS

CN 102768824 A 11/2012
JP 2013-205791 A 10/2013
KR 10-2006-0081572 A 7/2006
WO 2011/083784 A1 7/2011

OTHER PUBLICATIONS

Office Action in Chinese Patent Application No. 201410433197.8, dated Sep. 20, 2016.

* cited by examiner

SOURCE DRIVER CIRCUIT, METHOD FOR DRIVING DISPLAY PANEL AND DISPLAY DEVICE

CROSS-REFERENCE TO RELATED APPLICATION

The present application claims a priority of the Chinese patent application No. 201410433197.8 filed on Aug. 28, 2014, which is incorporated herein by reference in its entirety.

FIELD OF THE INVENTION

The present disclosure relates to the field of display technology, in particular to a source driver circuit applicable to a four-primary-color pixel unit, a method for driving a display panel and a display device.

DESCRIPTION OF THE PRIOR ART

Driver circuits for a thin film transistor liquid crystal display (TFT-LCD) include a power integrated circuit (Power IC), a timing controller IC, a grayscale IC, a source driver IC, a gate driver IC, and a system interface (System I/F), etc.

As shown in FIG. 1, the timing controller circuit generates display-related drive control signals and data based on image data inputted from the outside, and transmits them to the source driver IC, so that the source driver circuit converts the display-related drive control signals into corresponding analog voltage signals and outputs them to a display panel. These drive control signals may include a polarity reversal signal (POL) for controlling a polarity of the data outputted by the source driver circuit within each frame.

FIG. 2 is a schematic view showing the data output between an existing source driver circuit and a display panel with a three-primary-color pixel unit (Dot). As shown in FIG. 2, an existing pixel driving method may be used to enable polarities of driving voltages, i.e., positive and negative, for subpixels at odd-numbered positions and at even-numbered positions in the three-primary-color pixel unit to be different from each other, i.e., to achieve a phase difference of 180°. In addition, the subpixels at identical positions in adjacent pixel units are also of different polarities. As a result, horizontal polarity inclination may be prevented, and then the occurrence of crosstalk may be avoided. In FIG. 2, Dn represents an $n^{th}$ data line connecting the source driver circuit to the pixel unit, an unshaded region, e.g., R1 and B1, represents a region where the subpixel is in a positive polarity drive mode, a shaded region, e.g., G1, R2, represents a region where the subpixel is in a negative polarity drive mode. Rn, Gn and Bn represent positions of subpixels for displaying corresponding primary colors in an $n^{th}$ pixel unit, respectively. The same reference signs in the other drawings have the same meaning.

Along with the development of the display technology, the subpixels included in each pixel unit of the existing display panel are changed from being in the three primary colors (Red, Green and Blue) to being in the four primary colors (Red, Green, Blue and White), so as to provide rich and natural colors.

However, if the existing pixel driving method is adopted, there is such a phenomenon as shown in FIG. 3 for the four-primary-color pixel unit, i.e., the polarities of the driving voltages for the subpixels at the same positions (e.g., R1 and R2) in the adjacent pixel units are the same, resulting that crosstalk occurs at the display panel.

SUMMARY OF THE INVENTION

The present disclosure provides a source driver IC, a method for driving a display panel, and a display device, which can prevent the occurrence of crosstalk at a display panel and thus ensure the image quality.

Technical solutions provided in the present disclosure are as follows.

One embodiment of the present disclosure provides a source driver circuit connected to a display panel. The display panel includes a plurality of pixel units, each of which includes a first subpixel, a second subpixel, a third subpixel and a fourth subpixel arranged sequentially in a horizontal direction.

The source driver circuit includes:

a first sub-driver circuit connected to pixel electrodes corresponding to pixel units at odd-numbered positions in each pixel row and configured to, within a time period, transmit voltage signals at corresponding potentials to the pixel electrodes corresponding to the pixel units at the odd-numbered positions, so as to control, within the time period, polarities of driving voltages for the first subpixels and the third subpixels in the pixel units at the odd-numbered positions to be reverse to polarities of driving voltages for the second subpixels and the fourth subpixels in the pixel units at the odd-numbered positions; and a second sub-driver circuit connected to pixel electrodes corresponding to pixel units at even-numbered positions in each pixel row and configured to, within the time period, transmit voltage signals at corresponding potentials to the pixel electrodes corresponding to the pixel units at the even-numbered positions, so as to control polarities of driving voltages for the first subpixels and the third subpixels in the pixel units at the even-numbered positions to be identical to the polarities of the driving voltages for the second subpixels and the fourth subpixels in the pixel units at the odd-numbered positions, and control, within the time period, polarities of driving voltages for the second subpixels and the fourth subpixels in the pixel units at the even-numbered positions to be identical to the polarities of the driving voltages for the first subpixels and the third subpixels in the pixel units at the odd-numbered positions.

Optionally, the first sub-driver circuit includes:

a first control module configured to generate a first voltage signal at a first potential greater than a potential of a common electrode in the display panel based on a logic digital signal, and connected to a logic digital signal generation unit, a first analog voltage input end and a second analog voltage input end;

a second control module configured to generate a second voltage signal at a second potential less than the potential of the common electrode based on the logic digital signal, and connected to the logic digital signal generation unit, the second analog voltage input end and a third analog voltage input end;

a first output end configured to transmit the first voltage signal or the second voltage signal to the pixel electrodes corresponding to the first subpixels and the third subpixels in the pixel units at the odd-numbered positions, and connected to the pixel electrodes corresponding to the first subpixels and the third subpixels in the pixel units at the odd-numbered positions;

a second output end configured to transmit the second voltage signal or the first voltage signal to the pixel electrodes corresponding to the second subpixels and the fourth subpixels in the pixel units at the odd-numbered positions, and connected to the pixel electrodes corresponding to the second subpixels and the fourth subpixels in the pixel units at the odd-numbered positions; and a first selection switch configured to, based on a control logic, connect the first output end to the first control module and connect the second output end to the second control module within a first display duration of the time period so that the first output end outputs the first voltage signal and the second output end outputs the second voltage signal, and connect the first output end to the second control module and connect the second output end to the first control module within a second display duration of the time period so that the first output end outputs the second voltage signal and the second output end outputs the first voltage signal, the first selection switch being connected to the first control module, the second control module, the first output end and the second output end, and the first display duration and the second display duration alternating within the time period.

Optionally, the first control module includes:

a first level shifter configured to select from the logic digital signals a first digital voltage signal corresponding to the first voltage signal, and connected to the logic digital signal generation unit;

a first digital-to-analog converter configured to convert the first digital voltage signal into a corresponding first analog voltage signal, and connected to the first level shifter, the first analog voltage input end and the second analog voltage input end; and a first amplifier configured to amplify the first analog voltage signal, and connected to the first digital-to-analog converter and the first selection switch.

Optionally, the second control module includes:

a second level shifter configured to select from the logic digital signals a second digital voltage signal corresponding to the second voltage signal, and connected to the logic digital signal generation unit;

a second digital-to-analog converter configured to convert the second digital voltage signal into a corresponding second analog voltage signal, and connected to the second level shifter, the second analog voltage input end and the third analog voltage input end; and a second amplifier configured to amplify the second analog voltage signal, and connected to the second digital-to-analog converter and the first selection switch.

Optionally, the second sub-driver circuit includes:

a third control module configured to generate a third voltage signal at a third potential greater than the potential of the common electrode in the display panel based on the logic digital signal, and connected to the logic digital signal generation unit, the first analog voltage input end and the second analog voltage input end;

a fourth control module configured to generate a fourth voltage signal at a fourth potential less than the potential of the common electrode based on the logic digital signal, and connected to the logic digital signal generation unit, the second analog voltage input end and the third analog voltage input end;

a third output end configured to transmit the fourth voltage signal or the third voltage signal to the pixel electrodes corresponding to the second subpixels and the fourth subpixels in the pixel units at the even-numbered positions, and connected to the pixel electrodes corresponding to the second subpixels and the fourth subpixels in the pixel units at the even-numbered positions;

a fourth output end configured to transmit the third voltage signal or the fourth voltage signal to the pixel electrodes corresponding to the first subpixels and the third subpixels in the pixel units at the even-numbered positions, and connected to the pixel electrodes corresponding to the first subpixels and the third subpixels in the pixel units at the even-numbered positions; and a second selection switch configured to, based on a control logic, connect the third output end to the fourth control module and connect the fourth output end to the third control module within the first display duration of the time period so that the third output end outputs the fourth voltage signal and the fourth output end outputs the third voltage signal, and connect the third output end to the third control module and connect the fourth output end to the fourth control module within the second display duration of the time period so that the third output end outputs the third voltage signal and the fourth output end outputs the fourth voltage signal, the second selection switch being connected to the third control module, the fourth control module, the third output end and the fourth output end, and the first display duration and the second display duration alternating within the time period.

Optionally, the third control module includes:

a third level shifter configured to select from the logic digital signals a third digital voltage signal corresponding to the third voltage signal, and connected to the logic digital signal generation unit;

a third digital-to-analog converter configured to convert the third digital voltage signal into a corresponding third analog voltage signal, and connected to the third level shifter, the first analog voltage input end and the second analog voltage input end; and a third amplifier configured to amplify the third analog voltage signal, and connected to the third digital-to-analog converter and the second selection switch.

Optionally, the fourth control module includes:

a fourth level shifter configured to select from the logic digital signals a fourth digital voltage signal corresponding to the fourth voltage signal, and connected to the logic digital signal generation unit;

a fourth digital-to-analog converter configured to convert the fourth digital voltage signal into a corresponding fourth analog voltage signal, and connected to the fourth level shifter, the second analog voltage input end and the third analog voltage input end; and a fourth amplifier configured to amplify the fourth analog voltage signal, and connected to the fourth digital-to-analog converter and the second selection switch.

One embodiment of the present disclosure provides a method for driving a display panel. The display panel includes a plurality of pixel units, each of which includes a first subpixel, a second subpixel, a third subpixel and a fourth subpixel arranged sequentially in a horizontal direction.

The method includes steps of:

within a time period, transmitting voltage signals at corresponding potentials to pixel electrodes corresponding to the pixel units at odd-numbered positions in each pixel row, so as to control, within the time period, polarities of driving voltages for the first subpixels and the third subpixels in the pixel units at the odd-numbered positions to be reverse to polarities of driving voltages for the second subpixels and the fourth subpixels in the pixel units at the odd-numbered positions; and within the time period, transmit voltage signals at corresponding potentials to the pixel electrodes corresponding to the pixel units at even-numbered positions, so as to control, within the time period, polarities of driving voltages for the first subpixels and the third subpixels in the pixel units at the even-numbered positions to be identical to the polarities of the driving voltages for the second subpixels and the fourth subpixels in the pixel units at the odd-numbered positions, and control, within the time period, polarities of driving voltages for the second subpixels and the fourth subpixels in the pixel units at the even-numbered positions to be identical to the polarities of the driving voltages for the first subpixels and the third subpixels in the pixel units at the odd-numbered positions.

Optionally, the step of within a time period, transmitting voltage signals at corresponding potentials to pixel electrodes corresponding to the pixel units at odd-numbered positions in each pixel row, so as to control, within the time period, polarities of driving voltages for the first subpixels and the third subpixels in the pixel units at the odd-numbered positions to be reverse to polarities of driving voltages for the second subpixels and the fourth subpixels in the pixel units at the odd-numbered positions includes:

generating a first voltage signal at a first potential greater than a potential of a common electrode in the display panel and a second voltage signal at a second potential less than the potential of the common electrode in the display panel based on a logic digital signal; and based on a control logic, connecting a first output end to a first control module and connecting a second output end to a second control module within a first display duration of the time period so that the first output end outputs the first voltage signal and the second output end outputs the second voltage signal, and connecting the first output end to the second control module and connecting the second output end to the first control module within a second display duration of the time period so that the first output end outputs the second voltage signal and the second output end outputs the first voltage signal, the first display duration and the second display duration alternating in the time period.

Optionally, the step of, within the time period, transmitting voltage signals at corresponding potentials to the pixel electrodes corresponding to the pixel units at even-numbered positions, so as to control, within the time period, polarities of driving voltages for the first subpixels and the third subpixels in the pixel units at the even-numbered positions to be identical to the polarities of the driving voltages for the second subpixels and the fourth subpixels in the pixel units at the odd-numbered positions, and control, within the time period, polarities of driving voltages for the second subpixels and the fourth subpixels in the pixel units at the even-numbered positions to be identical to the polarities of the driving voltages for the first subpixels and the third subpixels in the pixel units at the odd-numbered positions includes:

based on the logic digital signal, generating a third voltage signal at a third potential greater than the potential of the common electrode in the display panel and a fourth voltage signal at a fourth potential less than the potential of the common electrode in the display panel; and based on the control logic, connecting a third output end to a fourth control module and connecting a fourth output end to a third control module within the first display duration of the time period so that the third output end outputs a fourth voltage signal and the fourth output end outputs a third voltage signal, and connecting the third output end to the third control module and connecting the fourth output end to the fourth control module within the second display duration of the time period so that the third output end outputs the third voltage signal and the fourth output end outputs the fourth voltage signal, the first display duration and the second display duration alternating within the time period.

One embodiment of the present disclosure provides a display device including the above-mentioned source driver IC.

According to the source driver IC, the method for driving the display panel and the display device of the present disclosure, the first sub-driver circuit is provided to, within the time period, control the polarities of the driving voltages for the first subpixels and the third subpixels in the pixel units at the odd-numbered positions in the pixel row to be reverse to the polarities of the driving voltages for the second subpixels and the fourth subpixels in the pixel units at the odd-numbered positions in the pixel row, and the second sub-driver circuit is provided to, within the time period, control the polarities of the driving voltages for the first subpixels and the third subpixels in the pixel units at the even-numbered positions to be identical to the polarities of the driving voltages for the second subpixels and the fourth subpixels in the pixel units at the odd-numbered positions but reverse to the polarities of the driving voltages for the second subpixels and the fourth subpixels in the pixel units at the even-numbered positions. As a result, the occurrence of crosstalk at the display panel may be prevented, thereby to ensure the image quality.

DETAILED DESCRIPTION OF THE PREFERRED EMBODIMENTS

In order to make the objects, the technical solutions and the advantages of embodiments of the present disclosure more apparent, the technical solutions of the embodiments of the present disclosure will be described hereinafter in a clear and complete manner in conjunction with the drawings. Obviously, the following embodiments merely relate to a part of, rather than all of, the embodiments of the present disclosure, and based on them, a person skilled in the art can obtain other embodiments, which also fall within the scope of the present disclosure.

Unless otherwise defined, any technical or scientific term used herein shall have the common meaning understood by a person of ordinary skills. Such words as "first" and "second" used in the specification and claims are merely used to differentiate components from each other, rather than to represent any order, number or importance. Similarly, such words as "one" or "one of" are merely used to represent the existence of at least one member, rather than to limit the number thereof. Such words as "connect" or "connected to" may include electrical connection, direct or indirect, rather than to be limited to physical or mechanical connection. Such words as "on", "under", "left" and "right" are merely used to represent relative position relationship, and when an absolute position of the object is changed, the relative position relationship will be changed too.

One embodiment of the present disclosure provides a source driver circuit connected to a display panel. The display panel may include a plurality of pixel units, each of which includes a first subpixel, a second subpixel, a third subpixel and a fourth subpixel arranged sequentially in a horizontal direction.

Figure 1:
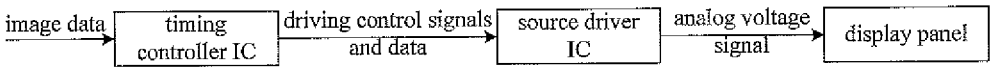
FIG. 1 is a schematic view showing a driving principle of a display panel in the related art.
Figure 2:
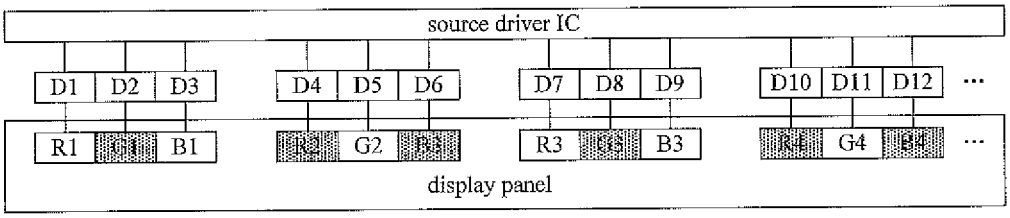
FIG. 2 is a schematic view showing data output between a source driver circuit and a display panel with three-primary-color pixel units in the related art.
Figure 3:
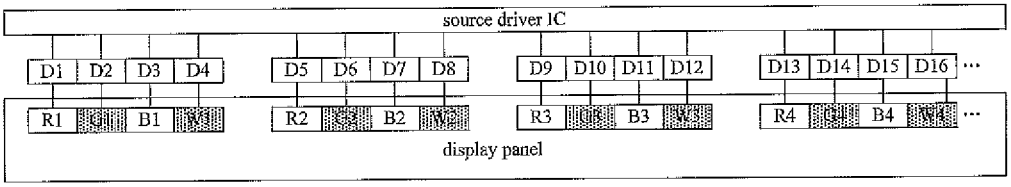
FIG. 3 is a schematic view showing data output between a source driver circuit and a display panel with four-primary-color pixel units in the related art.
Figure 4:
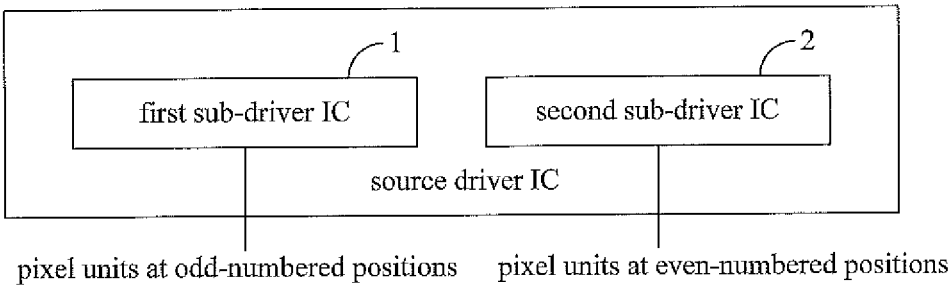
FIG. 4 is a schematic view showing a source driver circuit according to one embodiment of the present disclosure.

As shown in FIG. 4, the source driver circuit provided in one embodiment of the present disclosure may include:

a first sub-driver circuit 1 connected to pixel electrodes corresponding to pixel units at odd-numbered positions in each pixel row of the display panel and configured to, within a time period, transmit voltage signals at corresponding potentials to the pixel electrodes corresponding to the pixel units at the odd-numbered positions, so as to control, within the time period, polarities of driving voltages for the first subpixel and the third subpixel in the pixel units at the odd-numbered positions to be reverse to polarities of driving voltages for the second subpixel and the fourth subpixel in the pixel units at the odd-numbered positions; and a second sub-driver circuit 2 connected to pixel electrodes corresponding to pixel units at even-numbered positions in each pixel row of the display panel and configured to, within the time period, transmit voltage signals at corresponding potentials to the pixel electrodes corresponding to the pixel units at the even-numbered positions, so as to control polarities of driving voltages for the first subpixel and the third subpixel in the pixel units at the even-numbered positions to be identical to the polarities of the driving voltages for the second subpixel and the fourth subpixel in the pixel units at the odd-numbered positions, and control, within the time period, polarities of driving voltages for the second subpixel and the fourth subpixel in the pixel units at the even-numbered positions to be identical to the polarities of the driving voltages for the first subpixel and the third subpixel in the pixel units at the odd-numbered positions.

According to the source driver circuit of this embodiment, in the four-primary-color display panel, the polarities of the driving voltages for the subpixels at the same positions in the adjacent pixel units are controlled to be reverse to each other within a display duration. As a result, the occurrence of crosstalk may be prevented when an image is displayed at the display panel, thereby ensuring the image quality.

Figure 5:
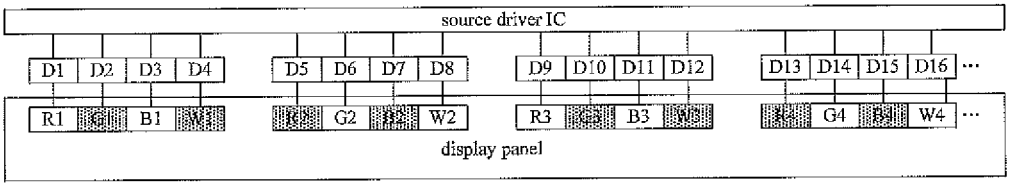
FIG. 5 is a schematic view showing a situation where a display panel is driven by the source driver circuit according to the one embodiment of the present disclosure.

For example, as shown in FIG. 5, the source driver circuit of this embodiment may enable the polarities of the driving voltages for the subpixels at the same positions in the adjacent pixel units to be reverse to each other. As shown in FIG. 5, the polarities of the driving voltages for the subpixels at positions R1, R2, R3 and R4 may be positive, negative, positive and negative, respectively, so that the polarities of the driving voltages for the subpixels for displaying a red color in the adjacent pixel units are different from each other, and as a result, so as to prevent the occurrence of crosstalk.

In FIG. 5, Rn may represent a position of the subpixel for displaying a red color in an $n^{th}$ pixel unit in a pixel row, and similarly, Gn, Bn and Wn may represent positions of the subpixels for displaying green, blue and white colors, respectively.

Figure 6:
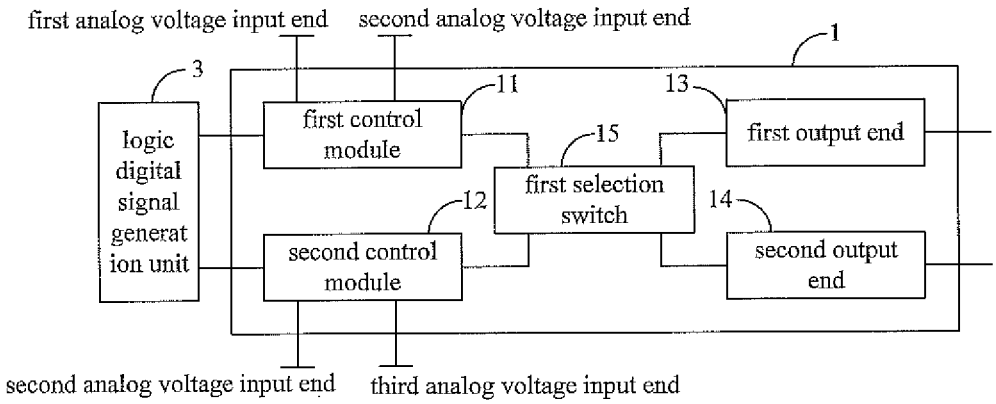
FIG. 6 is a schematic view showing a first driver circuit according to one embodiment of the present disclosure.

In an optional embodiment, as shown in FIG. 6, the first sub-driver circuit 1 specifically includes:

a first control module 11 configured to generate a first voltage signal V1 at a first potential based on a logic digital signal.

The first control module 11 may specifically be connected to a logic digital signal generation unit 3, a first analog voltage input end and a second analog voltage input end. The logic digital signal generation unit 3 may be configured to generate the corresponding logic digital signals including display-related information such as display grayscale information. The first analog voltage input end and the second analog voltage input end may be configured to input corresponding analog voltage signals (AVDD), so that the first control module 11 generates the first voltage signal V1.

In this embodiment, the first analog voltage input end may input an analog voltage signal at the greatest potential, the second analog voltage input end may input an analog voltage signal at a potential half the greatest potential, and a third analog voltage input end may input an analog voltage signal, e.g., at 0V.

The first voltage signal V1 generated by the first control module 11 may be at a high level, i.e., a positive voltage signal. In other words, the potential of the first voltage signal V1 may be greater than a potential of a common electrode (Vcom) in the display panel, so that the driving voltage for the subpixel that receives the first voltage signal is positive.

The logic digital signal generation unit 3 in this embodiment may be a device of an existing source driver IC.

As shown in FIG. 6, the first sub-driver circuit 1 may further include:

a second control module 12 configured to generate a second voltage signal V2 at a second potential based on the logic digital signal generated by the logic digital signal generation unit 3.

The second control module 12 may be connected to the logic digital signal generation unit 3, the second analog voltage input end and the third analog voltage input end. The second analog voltage input end and the third analog voltage input end may be used to input the corresponding analog voltage signals, so that the second control module 12 generates the second voltage signal V2.

The second voltage signal V2 generated by the second control module 12 may be at a low level, i.e., a negative voltage signal. In other words, the potential of the second voltage signal V2 may be less than the potential of the common electrode in the display panel, so that the driving voltage for the subpixel that receives the second voltage signal V2 is negative.

As shown in FIG. 6, the first sub-driver circuit 1 may further include:

a first output end (OUT1) 13 configured to transmit the first voltage signal V1 or the second voltage signal V2 to the pixel electrodes (not shown in FIG. 6) corresponding to the first subpixel (e.g., the subpixels at positions R1 and R3 in FIG. 5) and the third subpixel (e.g., the subpixels at positions B1 and B3 in FIG. 5) in the pixel units at the odd-numbered positions, and connected to the pixel electrodes corresponding to the first subpixel and the third subpixel in the pixel units at the odd-numbered positions; and a second output end (OUT2) 14 configured to transmit the second voltage signal V2 or the first voltage signal V1 to the pixel electrodes corresponding to the second subpixel (e.g., the subpixels at positions G1 and G3 in FIG. 5) and the fourth subpixel (e.g., the subpixels at positions W1 and W3 in FIG. 5) in the pixel units at the odd-numbered positions, and connected to the pixel electrodes corresponding to the second subpixel and the fourth subpixel in the pixel units at the odd-numbered positions.

As shown in FIG. 6, the first sub-driver circuit 1 may further include:

a first selection switch (SW1) 15 configured to, based on a control logic, connect the first output end 13 to the first control module 11 and connect the second output end 14 to the second control module 12 within a first display duration of the time period so that the first output end 13 outputs the first voltage signal V1 and the second output end 14 outputs the second voltage signal VG2, and connect the first output end 13 to the second control module 12 and connect the second output end 14 to the first control module 11 within a second display duration of the time period so that the first output end 13 outputs the second voltage signal V2 and the second output end 14 outputs the first voltage signal V1, the first selection switch 15 being connected to the first control module 11, the second control module 12, the first output end 13 and the second output end 14.

Figure 7:
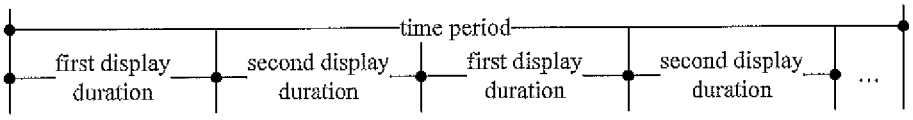
FIG. 7 is a sequence diagram of the source driver circuit according to one embodiment of the present disclosure.

In this embodiment, as shown in FIG. 7, the first display duration and the second display duration each may be a duration desired for displaying a frame, and within the time period (i.e., a display period), the first display duration and the second display duration alternate.

In other words, in this embodiment, the first selection switch 15 may be used to, with the first display duration or the second display duration as a switching period (e.g., the time desired for displaying a frame), enable the first output end 13 to be connected to the first control module 11 and the second control module 12 alternately and meanwhile enable the second output end 14 to be connected to the second control module 12 and the first control module 11 alternately within the time period, so as to enable the first output end 13 and the second output end 14 to output different driving signals for the pixel electrodes synchronously. As a result, in one pixel row, the polarities of the driving voltages for the first subpixel and the third subpixel in the pixel units at the odd-numbered positions are controlled to be reverse to the polarities of the driving voltages for the second subpixel and the fourth subpixels in the pixel units at the odd-numbered positions, thereby to prevent the occurrence of crosstalk.

For example, within the first display duration, the first selection switch 15 enables the first signal output end 13 to be connected to the first control module 11 and enables the second signal output end 14 to be connected to the second control module 12, so that the first signal output end 13 outputs the first voltage signal V1 (the positive voltage signal) and the second signal output end 14 outputs the second voltage signal V2 (the negative voltage signal). Within the second display duration, the first selection switch 15 enables the first signal output end 13 to be connected to the second control module 12 and enables the second signal output end 14 to be connected to the first control module 11, so that the first signal output end 13 outputs the second voltage signal V2 (the negative voltage signal) and the second signal output end 14 outputs the first voltage signal V1 (the positive voltage signal).

Figure 8:
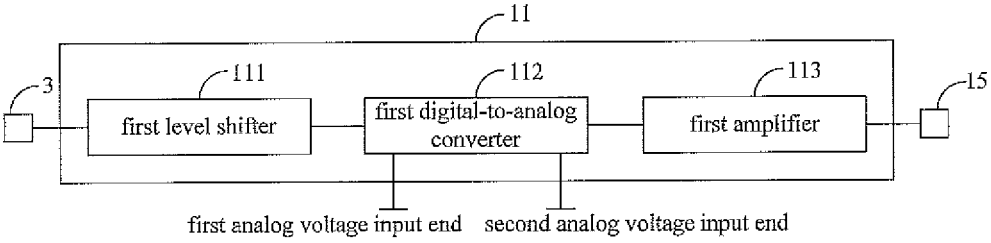
FIG. 8 is a schematic view showing a first control module according to one embodiment of the present disclosure.

In one embodiment, as shown in FIG. 8, the first control module 11 may specifically include:

a first level shifter 111 configured to select from the logic digital signals a first digital voltage signal corresponding to the first voltage signal V1, and connected to the logic digital signal generation unit 3;

a first digital-to-analog converter (DAC) 112 configured to convert the first digital voltage signal into a corresponding first analog voltage signal, and connected to the first level shifter 111, the first analog voltage input end and the second analog voltage input end; and a first amplifier (AMP) 113 configured to amplify the first analog voltage signal, and connected to the first digital-to-analog converter 112 and the first selection switch 15.

In one embodiment of the present disclosure, the first level shifter 111, the first digital-to-analog converter 112 and the first amplifier 113 each may use any known device in the related art, which is not particularly defined herein.

Figure 9:
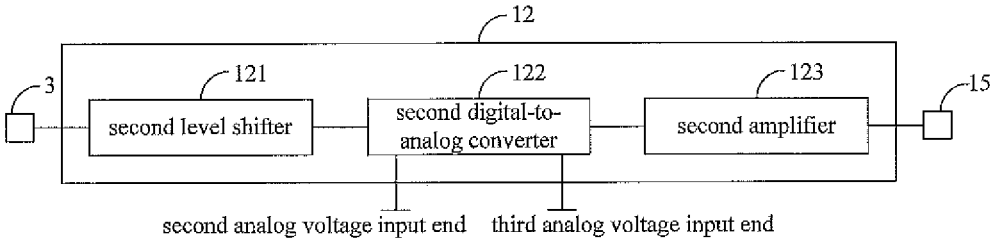
FIG. 9 is a schematic view showing a second control module according to one embodiment of the present disclosure.

As shown in FIG. 9, in one embodiment of the present disclosure, the second control module 12 may include:

a second level shifter 121 configured to select from the logic digital signals a second digital voltage signal corresponding to the second voltage signal V2, and connected to the logic digital signal generation unit 3;

a second digital-to-analog converter 122 configured to convert the second digital voltage signal into a corresponding second analog voltage signal, and connected to the second level shifter 121, the second analog voltage input end and the third analog voltage input end; and a second amplifier 123 configured to amplify the second analog voltage signal, and connected to the second digital-to-analog converter 122 and the first selection switch 15.

Figure 10:
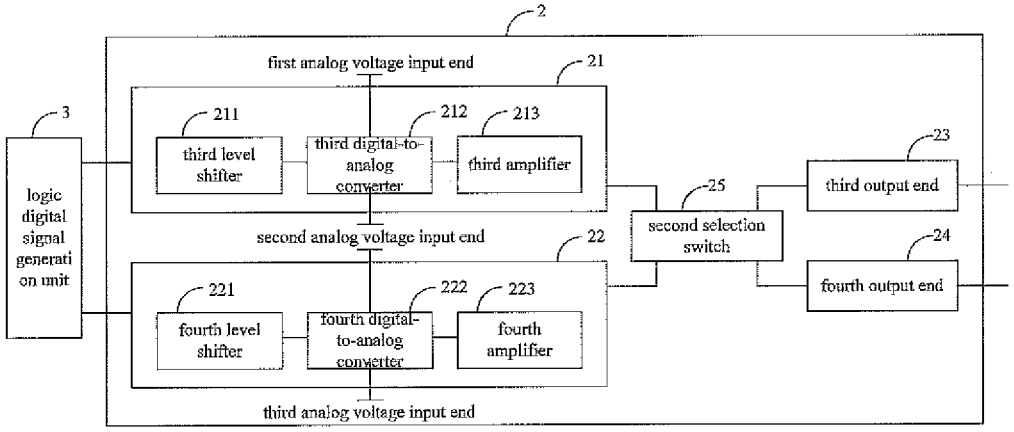
FIG. 10 is a schematic view showing a second driver circuit according to one embodiment of the present disclosure.

In an optional embodiment, as shown in FIG. 10, the second sub-driver circuit 2 may include:

a third control module 21 configured to generate a third voltage signal V3 at a third potential based on an input logic digital signal.

The third control module 21 may be connected to the logic digital signal generation unit 3, the first analog voltage input end and the second analog voltage input end.

The third voltage signal V3 generated by the third control module 21 may be at a high level, i.e., a positive voltage signal. In other words, the potential of the third voltage signal V3 may be greater than the potential of the common electrode in the display panel, so that the driving voltage for the subpixel that receives the third voltage signal is positive.

As shown in FIG. 10, the second sub-driver circuit 2 may further include:

a fourth control module 22 configured to generate a fourth voltage signal V4 at a fourth potential based on the logic digital signal.

The fourth control module 22 may be connected to the logic digital signal generation unit 3, the second analog voltage input end and the third analog voltage input end.

The fourth voltage signal V4 generated by the fourth control module 22 may be at a low level, i.e., a negative voltage signal. In other words, the potential of the fourth voltage signal V4 may be less than the potential of the common electrode in the display panel, so that the driving voltage for the subpixel that receives the fourth voltage signal V4 is negative.

As shown in FIG. 10, the second sub-driver circuit 2 may further include:

a third output end (OUT3) 23 configured to transmit the fourth voltage signal V4 or the third voltage signal V3 to the pixel electrodes corresponding to the second subpixel (e.g., the subpixels at positions G2 and G4 in FIG. 5) and the fourth subpixel (e.g., the subpixels at positions W2 and W4 in FIG. 5) in the pixel units at the even-numbered positions, and connected to the pixel electrodes corresponding to the second subpixel and the fourth subpixel in the pixel units at the even-numbered positions; and a fourth output end (OUT4) 24 configured to transmit the third voltage signal V3 or the fourth voltage signal V4 to the pixel electrodes corresponding to the first subpixel (e.g., the subpixels at positions R2 and R4 in FIG. 5) and the third subpixel (e.g., the subpixels at positions B2 and B4 in FIG. 5) in the pixel units at the even-numbered positions, and connected to the pixel electrodes corresponding to the first subpixel and the third subpixel in the pixel units at the even-numbered positions.

As shown in FIG. 10, the second sub-driver circuit 2 may further include:

a second selection switch 25 configured to, based on the control logic, connect the third output end 23 to the fourth control module 22 and connect the fourth output end 24 to the third control module 21 within the first display duration so that the third output end 23 outputs the fourth voltage signal V4 and the fourth output end 24 outputs the third voltage signal V3, and connect the third output end 23 to the third control module 21 and connect the fourth output end 24 to the fourth control module 22 within the second display duration so that the third output end 23 outputs the third voltage signal V3 and the fourth output end 24 outputs the fourth voltage signal V4, the second selection switch 25 being connected to the third control module 21, the fourth control module 22, the third output end 23 and the fourth output end 24.

In this embodiment, the second selection switch 25 may be used to, with the first display duration or the second display duration as a switching period (e.g., the time desired for displaying a frame), enable the third output end 23 and the fourth output end 24 to be alternately connected to the third control module 21 and the fourth control module 22, respectively, within the display period, so as to enable the third output end 23 and the fourth output end 24 to output different driving signals for the pixel electrodes synchronously. As a result, in one pixel row, the polarities of the driving voltages for the first subpixel and the third subpixel in the pixel units at the even-numbered positions are controlled to be reverse to the polarities of the driving voltages for the second subpixel and the fourth subpixels in the pixel units at the even-numbered positions (but identical to the polarities of the driving voltages for the second subpixel and the fourth subpixel in the pixel units at the odd-numbered positions), thereby to prevent the occurrence of crosstalk.

For example, within the first display duration, the second selection switch 25 enables the third signal output end 23 to be connected to the fourth control module 22, and enables the fourth signal output end 24 to be connected to the third control module 21, so that the third signal output end 23 outputs the fourth voltage signal V4 (the negative voltage signal) and the fourth signal output end 24 outputs the third voltage signal V3 (the positive voltage signal). Within the second display duration, the second selection switch 25 enables the third signal output end 23 to be connected to the third control module 21 and enables the fourth signal output end 24 to be connected to the fourth control module 22, so that the third signal output end 23 outputs the third voltage signal V3 (the positive voltage signal) and the fourth signal output end 24 outputs the fourth voltage signal V4 (the negative voltage signal).

As shown in FIG. 10, in one embodiment, the third control module 21 may include:

a third level shifter 211 configured to select from the logic digital signals a third digital voltage signal corresponding to the third voltage signal V3, and connected to the logic digital signal generation unit 3;

a third digital-to-analog converter 212 configured to convert the third digital voltage signal into a corresponding third analog voltage signal, and connected to the third level shifter 211, the first analog voltage input end and the second analog voltage input end; and a third amplifier 213 configured to amplify the third analog voltage signal, and connected to the third digital-to-analog converter 212 and the second selection switch 25.

As shown in FIG. 10, in one embodiment, the fourth control module 22 may include:

a fourth level shifter 221 configured to select from the logic digital signals a fourth digital voltage signal corresponding to the fourth voltage signal V4, and connected to the logic digital signal generation unit 3;

a fourth digital-to-analog converter 222 configured to convert the fourth digital voltage signal into a corresponding fourth analog voltage signal, and connected to the fourth level shifter 221, the second analog voltage input end and the third analog voltage input end; and a fourth amplifier 223 configured to amplify the fourth analog voltage signal, and connected to the fourth digital-to-analog converter 22 and the second selection switch 25.

In the above embodiments, the present disclosure is described by taking the source driver circuit merely provided with a set of driving ICs (i.e., the first sub-driver circuit 1 and the second sub-driver circuit 2) so as to control the polarities of the driving voltages for the pixel units at the odd-numbered positions and the even-numbered positions in the pixel row as an example. However, in other embodiments, the source driver circuit may also be provided with two or more sets of driver ICs connected to the corresponding pixel units, so as to control the polarities of the driving voltages for the subpixels at the corresponding positions in the pixel units to be different from each other, thereby to achieve the purpose of the present disclosure.

One embodiment of the present disclosure further provides a method for driving a display panel. The display panel includes a plurality of pixel units, each of which includes a first subpixel, a second subpixel, a third subpixel and a fourth subpixel arranged sequentially in a horizontal direction.

The method includes the steps of:

within a time period, transmitting voltage signals at corresponding potentials to pixel electrodes corresponding to the pixel units at odd-numbered positions in each pixel row, so as to control, within the time period, polarities of driving voltages for the first subpixel and the third subpixel in the pixel units at the odd-numbered positions to be reverse to polarities of driving voltages for the second subpixel and the fourth subpixel in the pixel units at the odd-numbered positions; and within the time period, transmit voltage signals at corresponding potentials to the pixel electrodes corresponding to the pixel units at even-numbered positions, so as to control, within the time period, polarities of driving voltages for the first subpixel and the third subpixel in the pixel units at the even-numbered positions to be identical to the polarities of the driving voltages for the second subpixel and the fourth subpixel in the pixel units at the odd-numbered positions, and control, within the time period, polarities of driving voltages for the second subpixel and the fourth subpixel in the pixel units at the even-numbered positions to be identical to the polarities of the driving voltages for the first subpixel and the third subpixel in the pixel units at the odd-numbered positions.

In an optional embodiment, the step of, within a time period, transmitting voltage signals at corresponding potentials to pixel electrodes corresponding to the pixel units at odd-numbered positions in each pixel row, so as to control, within the time period, polarities of driving voltages for the first subpixel and the third subpixel in the pixel units at the odd-numbered positions to be reverse to polarities of driving voltages for the second subpixel and the fourth subpixel in the pixel units at the odd-numbered positions specifically includes:

generating the first voltage signal V1 at a first potential greater than a potential of the common electrode in the display panel and the second voltage signal V2 at a second potential less than the potential of the common electrode in the display panel based on a logic digital signal; and based on a control logic, connecting the first output end 13 to the first control module 11 and connecting the second output end 14 to the second control module 12 within a first display duration of the time period so that the first output end 13 outputs the first voltage signal V1 and the second output end 14 outputs the second voltage signal V2, and connecting the first output end 13 to the second control module 12 and connecting the second output end 14 to the first control module 11 within a second display duration of the time period so that the first output end 13 outputs the second voltage signal V2 and the second output end 14 outputs the first voltage signal V1, the first display duration and the second display duration alternating within the time period.

In an optional embodiment, the step of, within the time period, transmit voltage signals at corresponding potentials to the pixel electrodes corresponding to the pixel units at even-numbered positions, so as to control, within the time period, polarities of driving voltages for the first subpixel and the third subpixel in the pixel units at the even-numbered positions to be identical to the polarities of the driving voltages for the second subpixel and the fourth subpixel in the pixel units at the odd-numbered positions, and control, within the time period, polarities of driving voltages for the second subpixel and the fourth subpixel in the pixel units at the even-numbered positions to be identical to the polarities of the driving voltages for the first subpixel and the third subpixel in the pixel units at the odd-numbered positions specifically includes:

based on the logic digital signal, generating the third voltage signal V3 having a third potential greater than the potential of the common electrode in the display panel and the fourth voltage signal V4 at a fourth potential less than the potential of the common electrode in the display panel; and based on the control logic, connecting the third output end 23 to the fourth control module 22 and connecting the fourth output end 24 to the third control module 21 within the first display duration of the time period so that the third output end 23 outputs the fourth voltage signal V4 and the fourth output end 24 outputs the third voltage signal V3, and connecting the third output end 23 to the third control module 21 and connecting the fourth output end 24 to the fourth control module 22 within the second display duration of the time period so that the third output end 23 outputs the third voltage signal V3 and the fourth output end 24 outputs the fourth voltage signal V4.

One embodiment of the present disclosure further provides a display device including the above-mentioned source driver IC.

The display device may be any electronic product having a display function.

According to the present disclosure, the first sub-driver circuit is provided to, within the time period, control the polarities of the driving voltages for the first subpixel and the third subpixel in the pixel units at the odd-numbered positions in the pixel row to be reverse to the polarities of the driving voltages for the second subpixel and the fourth subpixel in the pixel units at the odd-numbered positions in the pixel row, and the second sub-driver circuit is provided to, within the time period, control the polarities of the driving voltages for the first subpixel and the third subpixel in the pixel units at the even-numbered positions to be identical to the polarities of the driving voltages for the second subpixel and the fourth subpixel in the pixel units at the odd-numbered positions but reverse to the polarities of the driving voltages for the second subpixel and the fourth subpixel in the pixel units at the even-numbered positions. As a result, the occurrence of crosstalk at the display panel may be prevented, thereby to ensure the image quality.

The above are merely the optional embodiments of the present disclosure. It should be appreciated that, a person skilled in the art may make further improvements and modifications without departing from the principle of the present disclosure, and these improvements and modifications shall also fall within the scope of the present disclosure.

What is claimed is:

1. A source driver IC, connected to a display panel, the display panel comprising a plurality of pixel units, each of which comprises a first subpixel, a second subpixel, a third subpixel and a fourth subpixel arranged sequentially in a horizontal direction;

wherein the source driver circuit comprises:

a first sub-driver circuit connected to pixel electrodes corresponding to pixel units at odd-numbered positions in each pixel row and configured to, within a time period, transmit voltage signals at corresponding potentials to the pixel electrodes corresponding to the pixel units at the odd-numbered positions, so as to control, within the time period, polarities of driving voltages for the first subpixels and the third subpixels in the pixel units at the odd-numbered positions to be reverse to polarities of driving voltages for the second subpixels and the fourth subpixels in the pixel units at the odd-numbered positions; and a second sub-driver circuit connected to pixel electrodes corresponding to pixel units at even-numbered positions in each pixel row and configured to, within the time period, transmit voltage signals at corresponding potentials to the pixel electrodes corresponding to the pixel units at the even-numbered positions, so as to control polarities of driving voltages for the first subpixels and the third subpixels in the pixel units at the even-numbered positions to be identical to the polarities of the driving voltages for the second subpixels and the fourth subpixels in the pixel units at the odd-numbered positions, and control, within the time period, polarities of driving voltages for the second subpixels and the fourth subpixels in the pixel units at the even-numbered positions to be identical to the polarities of the driving voltages for the first subpixels and the third subpixels in the pixel units at the odd-numbered positions;

wherein the first sub-driver circuit comprises:

a first control module configured to generate a first voltage signal at a first potential greater than a potential of a common electrode in the display panel based on a logic digital signal, and connected to a logic digital signal generation unit, a first analog voltage input end and a second analog voltage input end;

a second control module configured to generate a second voltage signal at a second potential less than the potential of the common electrode based on the logic digital signal, and connected to the logic digital signal generation unit, the second analog voltage input end and a third analog, voltage input end;

a first output end configured to transmit the first voltage signal or the second voltage signal to the pixel electrodes corresponding to the first subpixels and the third subpixels in the pixel units at the odd-numbered positions, and connected to the pixel electrodes corresponding to the first subpixels and the third subpixels in the pixel units at the odd-numbered positions;

a second output end configured to transmit the second voltage signal or the first voltage signal to the pixel electrodes corresponding to the second subpixels and the fourth subpixels in the pixel units at the odd-numbered positions, and connected to the pixel electrodes corresponding to the second subpixels and the fourth subpixels in the pixel units at the odd-numbered positions; and a first selection switch configured to, based on a control logic, connect the first output end to the first control module and connect the second output end to the second control module within a first display duration of the time period so that the first output end outputs the first voltage signal and the second output end outputs the second voltage signal, and connect the first output end to the second control module and connect the second output end to the first control module within a second display duration of the time period so that the first output end outputs the second voltage signal and the second output end outputs the first voltage signal, the first selection switch being connected to the first control module, the second control module, the first output end and the second output end, and the first display duration and the second display duration alternating within the time period.

2. The source driver circuit according to claim 1, wherein the first control module comprises:

a first level shifter configured to select from the logic digital signals a first digital voltage signal corresponding to the first voltage signal, and connected to the logic digital signal generation unit;

a first digital-to-analog converter configured to convert the first digital voltage signal into a corresponding first analog voltage signal, and connected to the first level shifter, the first analog voltage input end and the second analog voltage input end; and a first amplifier configured to amplify the first analog voltage signal, and connected to the first digital-to-analog converter and the first selection switch.

3. The source driver circuit according to claim 1, wherein the second control module comprises:

a second level shifter configured to select from the logic digital signals a second digital voltage signal corresponding to the second voltage signal, and connected to the logic digital signal generation unit;

a second digital-to-analog converter configured to convert the second digital voltage signal into a corresponding second analog voltage signal, and connected to the second level shifter, the second analog voltage input end and the third analog voltage input end; and a second amplifier configured to amplify the second analog voltage signal, and connected to the second digital-to-analog converter and the first selection switch.

4. The source driver circuit according to claim 1, wherein the second sub-driver circuit comprises:

a third control module configured to generate a third voltage signal at a third potential greater than the potential of the common electrode in the display panel based on the logic digital signal, and connected to the logic digital signal generation unit, the first analog voltage input end and the second analog voltage input end;

a fourth control module configured to generate a fourth voltage signal at a fourth potential less than the potential of the common electrode based on the logic digital signal, and connected to the logic digital signal generation unit, the second analog voltage input end and the third analog voltage input end;

a third output end configured to transmit the fourth voltage signal or the third voltage signal to the pixel electrodes corresponding to the second subpixels and the fourth subpixels in the pixel units at the even-numbered positions, and connected to the pixel electrodes corresponding to the second subpixels and the fourth subpixels in the pixel units at the even-numbered positions;

a fourth output end configured to transmit the third voltage signal or the fourth voltage signal to the pixel electrodes corresponding to the first subpixels and the third subpixels in the pixel units at the even-numbered positions, and connected to the pixel electrodes corresponding to the first subpixels and the third subpixels in the pixel units at the even-numbered positions; and a second selection switch configured to, based on a control logic, connect the third output end to the fourth control module and connect the fourth output end to the third control module within the first display duration of the time period so that the third output end outputs the fourth voltage signal and the fourth output end outputs the third voltage signal, and connect the third output end to the third control module and connect the fourth output end to the fourth control module within the second display duration of the time period so that the third output end outputs the third voltage signal and the fourth output end outputs the fourth voltage signal, the second selection switch being connected to the third control module, the fourth control module, the third output end and the fourth output end, and the first display duration and the second display duration alternating within the time period.

5. The source driver circuit according to claim 4, wherein the third control module comprises:

a third level shifter configured to select from the logic digital signals a third digital voltage signal corresponding to the third voltage signal, and connected to the logic digital signal generation unit;

a third digital-to-analog converter configured to convert the third digital voltage signal into a corresponding third analog voltage signal, and connected to the third level shifter, the first analog voltage input end and the second analog voltage input end; and a third amplifier configured to amplify the third analog voltage signal, and connected to the third digital-to-analog converter and the second selection switch.

6. The source driver circuit according to claim 4, wherein the fourth control module comprises:

a fourth level shifter configured to select from the logic digital signals a fourth digital voltage signal corresponding to the fourth voltage signal, and connected to the logic digital signal generation unit;

a fourth digital-to-analog converter configured to convert the fourth digital voltage signal into a corresponding fourth analog voltage signal, and connected to the fourth level shifter, the second analog voltage input end and the third analog voltage input end; and a fourth amplifier configured to amplify the fourth analog voltage signal, and connected to the fourth digital-to-analog converter and the second selection switch.

7. A method for driving a display panel, the display panel comprising a plurality of pixel units, each of which includes a first subpixel, a second subpixel, a third subpixel and a fourth subpixel arranged sequentially in a horizontal direction, the method comprising:

within a time period, transmitting voltage signals at corresponding potentials to pixel electrodes corresponding to pixel units at odd-numbered positions in each pixel row, so as to control, within the time period, polarities of driving voltages for the first subpixels and the third subpixels in the pixel units at the odd-numbered positions to be reverse to polarities of driving voltages for the second subpixels and the fourth subpixels in the pixel units at the odd-numbered positions; and within the time period, transmitting voltage signals at corresponding potentials to pixel electrodes corresponding to pixel units at even-numbered positions, so as to control, within the time period, polarities of driving voltages for the first subpixels and the third subpixels in the pixel units at the even-numbered positions to be identical to the polarities of the driving voltages for the second subpixels and the fourth subpixels in the pixel units at the odd-numbered positions, and control, within the time period, polarities of driving voltages for the second subpixels and the fourth subpixels in the pixel units at the even-numbered positions to be identical to the polarities of the driving voltages for the first subpixels and the third subpixels in the pixel units at the odd-numbered positions;

wherein the step of, within a time period, transmitting voltage signals at corresponding potentials to pixel electrodes corresponding to pixel units at odd-numbered positions in each pixel row, so as to control, within the time period, polarities of driving voltages for the first subpixels and the third subpixels in the pixel units at the odd-numbered positions to be reverse to polarities of driving voltages for the second subpixels and the fourth subpixels in the pixel units at the odd-numbered positions comprises:

generating a first voltage signal at a first potential greater than a potential of a common electrode in the display panel and a second voltage signal at a second potential less than the potential of the common electrode in the display panel based on a logic digital signal; and based on a control logic, connecting a first output end to a first control module and connecting a second output end to a second control module within a first display duration of the time period so that the first output end outputs the first voltage signal and the second output end outputs the second voltage signal, and connecting the first output end to the second control module and connecting the second output end to the first control module within a second display duration of the time period so that the first output end outputs the second voltage signal and the second output end outputs the first voltage signal, the first display duration and the second display duration alternating in the time period.

8. The method according to claim 1, wherein the step of, within the time period, transmitting voltage signals at corresponding potentials to the pixel electrodes corresponding to the pixel units at even-numbered positions, so as to control, within the time period, polarities of driving voltages for the first subpixels and the third subpixels in the pixel units at the even-numbered positions to be identical to the polarities of the driving voltages for the second subpixels and the fourth subpixels in the pixel units at the odd-numbered positions, and control, within the time period, polarities of driving voltages for the second subpixels and the fourth subpixels in the pixel units at the even-numbered positions to be identical to the polarities of the driving voltages for the first subpixels and the third subpixels in the pixel units at the odd-numbered positions comprises:

based on the logic digital signal, generating a third voltage signal at a third potential greater than the potential of the common electrode in the display panel and a fourth voltage signal at a fourth potential less than the potential of the common electrode in the display panel; and based on a control logic, connecting a third output end to a fourth control module and connecting a fourth output end to a third control module within the first display duration of the time period so that the third output end outputs the fourth voltage signal and the fourth output end outputs the third voltage signal, and connecting the third output end to the third control module and connecting the fourth output end to the fourth control module within the second display duration of the time period so that the third output end outputs the third voltage signal and the fourth output end outputs the fourth voltage signal, the first display duration and the second display duration alternating within the time period.

9. A display device comprising a display panel and a source driver circuit connected to the display panel, wherein the display panel comprises a plurality of pixel units, each of which comprises a first subpixel, a second subpixel, a third subpixel and a fourth subpixel arranged sequentially in a horizontal direction;

wherein the source driver circuit comprises:

a first sub-driver circuit connected to pixel electrodes corresponding to pixel units at odd-numbered positions in each pixel row and configured to, within a time period, transmit voltage signals at corresponding potentials to the pixel electrodes corresponding to the pixel units at the odd-numbered positions, so as to control, within the time period, polarities of driving voltages for the first subpixels and the third subpixels in the pixel units at the odd-numbered positions to be reverse to polarities of driving voltages for the second subpixels and the fourth subpixels in the pixel units at the odd-numbered positions; and a second sub-driver circuit connected to pixel electrodes corresponding to pixel units at even-numbered positions in each pixel row and configured to, within the time period, transmit voltage signals at corresponding potentials to the pixel electrodes corresponding to the pixel units at the even-numbered positions, so as to control polarities of driving voltages for the first subpixels and the third subpixels in the pixel units at the even-numbered positions to be identical to the polarities of the driving voltages for the second subpixels and the fourth subpixels in the pixel units at the odd-numbered positions, and control, within the time period, polarities of driving voltages for the second subpixels and the fourth subpixels in the pixel units at the even-numbered positions to be identical to the polarities of the driving voltages for the first subpixels and the third subpixels in the pixel units at the odd-numbered positions;

wherein the second sub-driver circuit comprises:

a third control module configured to generate a third voltage signal at a third potential greater than the potential of the common electrode in the display panel based on the logic digital signal, and connected to the logic digital signal generation unit, the first analog voltage input end and the second analog voltage input end;

a fourth control module configured to generate a fourth voltage signal at a fourth potential less than the potential of the common electrode based on the logic digital signal, and connected to the logic digital signal generation unit, the second analog voltage input end and the third analog voltage input end;

a third output end configured to transmit the fourth voltage signal or the third voltage signal to the pixel electrodes corresponding to the second subpixels and the fourth subpixels in the pixel units at the even-numbered positions, and connected to the pixel electrodes corresponding to the second subpixels and the fourth subpixels in the pixel units at the even-numbered positions;

a fourth output end configured to transmit the third voltage signal or the fourth voltage signal to the pixel electrodes corresponding to the first subpixels and the third subpixels in the pixel units at the even-numbered positions, and connected to the pixel electrodes corresponding to the first subpixels and the third subpixels in the pixel units at the even-numbered positions; and a second selection switch configured to, based on a control logic, connect the third output end to the fourth control module and connect the fourth output end to the third control module within the first display duration of the time period so that the third output end outputs the fourth voltage signal and the fourth output end outputs the third voltage signal, and connect the third output end to the third control module and connect the fourth output end to the fourth control module within the second display duration of the time period so that the third output end outputs the third voltage signal and the fourth output end outputs the fourth voltage signal, the second selection switch being connected to the third control module, the fourth control module, the third output end and the fourth output end, and the first display duration and the second display duration alternating within the time period.

10. The display device according to claim 9, wherein the first sub-driver circuit comprises:

a first control module configured to generate a first voltage signal at a first potential greater than a potential of a common electrode in the display panel based on a logic digital signal, and connected to a logic digital signal generation unit, a first analog voltage input end and a second analog voltage input end;

a second control module configured to generate a second voltage signal at a second potential less than the potential of the common electrode based on the logic digital signal, and connected to the logic digital signal generation unit, the second analog voltage input end and a third analog voltage input end;

a first output end configured to transmit the first voltage signal or the second voltage signal to the pixel electrodes corresponding to the first subpixels and the third subpixels in the pixel units at the odd-numbered positions, and connected to the pixel electrodes corresponding to the first subpixels and the third subpixels in the pixel units at the odd-numbered positions;

a second output end configured to transmit the second voltage signal or the first voltage signal to the pixel electrodes corresponding to the second subpixels and the fourth subpixels in the pixel units at the odd-numbered positions, and connected to the pixel electrodes corresponding to the second subpixels and the fourth subpixels in the pixel units at the odd-numbered positions; and a first selection switch configured to, based on a control logic, connect the first output end to the first control module and connect the second output end to the second control module within a first display duration of the time period so that the first output end outputs the first voltage signal and the second output end outputs the second voltage signal, and connect the first output end to the second control module and connect the second output end to the first control module within a second display duration of the time period so that the first output end outputs the second voltage signal and the second output end outputs the first voltage signal, the first selection switch being connected to the first control module, the second control module, the first output end and the second output end, and the first display duration and the second display duration alternating within the time period.

11. The display device according to claim 10, wherein the first control module comprises:

a first level shifter configured to select from the logic digital signals a first digital voltage signal corresponding to the first voltage signal, and connected to the logic digital signal generation unit;

a first digital-to-analog converter configured to convert the first digital voltage signal into a corresponding first analog voltage signal, and connected to the first level shifter, the first analog voltage input end and the second analog voltage input end; and a first amplifier configured to amplify the first analog voltage signal, and connected to the first digital-to-analog converter and the first selection switch.

12. The display device according to claim 10, wherein the second control module comprises:

a second level shifter configured to select from the logic digital signals a second digital voltage signal corresponding to the second voltage signal, and connected to the logic digital signal generation unit;

a second digital-to-analog converter configured to convert the second digital voltage signal into a corresponding second analog voltage signal, and connected to the second level shifter, the second analog voltage input end and the third analog voltage input end; and a second amplifier configured to amplify the second analog voltage signal, and connected to the second digital-to-analog converter and the first selection switch.

13. The display device according to claim 9, wherein the third control module comprises:

a third level shifter configured to select from the logic digital signals a third digital voltage signal corresponding to the third voltage signal, and connected to the logic digital signal generation unit;

a third digital-to-analog converter configured to convert the third digital voltage signal into a corresponding third analog voltage signal, and connected to the third level shifter, the first analog voltage input end and the second analog voltage input end; and a third amplifier configured to amplify the third analog voltage signal, and connected to the third digital-to-analog converter and the second selection switch.

14. The display device according to claim 9, wherein the fourth control module comprises:

a fourth level shifter configured to select from the logic digital signals a fourth digital voltage signal corresponding to the fourth voltage signal, and connected to the logic digital signal generation unit;

a fourth digital-to-analog converter configured to convert the fourth digital voltage signal into a corresponding fourth analog voltage signal, and connected to the fourth level shifter, the second analog voltage input end and the third analog voltage input end; and a fourth amplifier configured to amplify the fourth analog voltage signal, and connected to the fourth digital-to-analog converter and the second selection switch.

* * * * *